United States Patent [19]

Evans

[11] 4,407,213

[45] Oct. 4, 1983

[54] CLEANING IMPLEMENT FOR BOATS

[76] Inventor: Peter R. Evans, 4 Hengrave Close, Stoke Park, Ipswich, Suffolk, England

[21] Appl. No.: 438,839

[22] Filed: Nov. 3, 1982

Related U.S. Application Data

[63] Continuation of Ser. No. 205,706, Nov. 10, 1980, abandoned.

[30] Foreign Application Priority Data

Nov. 15, 1979 [GB] United Kingdom ..... 7939540
Apr. 24, 1980 [GB] United Kingdom ..... 8013475

[51] Int. Cl.[3] ..... B63B 59/08

[52] U.S. Cl. ..... 114/222; 15/114; 15/184

[58] Field of Search ..... 114/222, 221, 51, 53, 114/318, 331; 15/114, 1.7, 184, DIG. 5; 132/85

[56] References Cited

U.S. PATENT DOCUMENTS 1,446,595 2/1923 Sumer ..... 132/85
2,080,334 5/1937 Petrovsky ..... 15/114
2,459,007 1/1945 Taylor ..... 15/DIG. 5
2,720,858 10/1955 Siefken ..... 114/222
3,010,420 11/1961 Glynn ..... 114/222
3,165,067 1/1965 Greenwald ..... 114/221 R

FOREIGN PATENT DOCUMENTS 450879 7/1936 United Kingdom ..... 114/222
467264 6/1937 United Kingdom ..... 114/222

*Primary Examiner*—Trygve M. Blix
*Assistant Examiner*—T. J. Brahan
*Attorney, Agent, or Firm*—Lawrence Rosen

[57] ABSTRACT

A cleaning implement for cleaning the bottom of a boat while the boat remains in the water comprising an elongate handle provided at one end with a buoyant cleaning head presenting a cleaning structure for contacting the bottom of the boat, when the cleaning head is submerged beneath the boat, so that the boat bottom can be cleaned by movement of the cleaning head over the boat bottom as a result of manipulation of the handle. The cleaning head may comprise a hollow stock into which water may be introduced to adjust the buoyancy of the cleaning head. The hollow stock may be provided with detachable cleaning devices which may be stored in the hollow stock when the implement is not in use.

4 Claims, 6 Drawing Figures

CLEANING IMPLEMENT FOR BOATS

This application is a continuation of Ser. No. 205,706, filed Nov. 10, 1980 now abandoned.

BACKGROUND OF THE INVENTION

This invention relates to a cleaning implement for use in cleaning a floating structure and, in particular, for cleaning the bottom of a small boat.

The speed of a sailing boat or power boat is dependent to a large degree upon the resistance presented by the hull to movement through the water, and the performance of the boat will be severely impaired if considerable amounts of fouling materials, such as weed and slime, are allowed to accumulate on the bottom of the boat below the water line.

In an attempt to counter this problem, it is common practice to coat the bottom of a boat with an anti-fouling preparation. Whilst this may retard the accumulation of fouling material on the boat bottom or facilitate removal of such material, it is still necessary periodically to clean the bottom of the boat so as mechanically to remove accumulated fouling material.

The current practice when cleaning boats to rid the bottom of the boat of accretions of fouling material is to remove the boat from the water and physically scrub and scrape the exposed bottom of the boat. However, this procedure involves removing the boat from the water and can prove expensive if the boat has to be lifted out of the water by a crane, for example because the boat is moored in a non-tidal area. Moreover, the exposure of the fouled bottom of the boat to the atmosphere tends to dry and harden the accumulated material on the hull and makes it difficult to remove. In view of the expense, cleaning tends to be at relatively long intervals of time and, as a result, considerable accumulations of fouling material may be built up, making the eventual task of removing the material even more arduous.

SUMMARY OF THE INVENTION

It is an object of the present invention to provide a simple cleaning implement which can be readily employed without undue effort to clean the bottom of the boat whilst the boat remains in the water, thereby encouraging cleaning of the boat bottom at frequent intervals so that undue aggregations of fouling materials do not build up and the performance of the boat is maintained at its optimum.

Accordingly, the present invention provides a cleaning implement for cleaning the bottom of a boat whilst the boat remains in the water, which implement comprises an elongate handle provided at one end with a buoyant cleaning head presenting a cleaning structure for contacting the bottom of the boat, when the cleaning head is submerged beneath the boat, so that the boat bottom can be cleaned by movement of the cleaning head over the boat bottom as a result of manipulation of the handle.

In one embodiment of the invention, the cleaning head comprises a stock to which is attached a body of buoyant material, such as synthetic plastics foam, which both imparts buoyancy to the cleaning head and constitutes the cleaning structure of the head.

If desired, the cleaning head may also be provided with bristles which can be used to exert a scrubbing action on the hull to remove more persistent fouling material. Suitably, the cleaning head has an area provided with relatively soft bristle and an area provided with relatively hard bristles. Advantageously, the soft bristles are longer than the hard bristles, so that the soft bristles can collapse to allow the hard bristles to engage the bottom of the boat when the force exerted on the cleaning head via the handle is increased to tackle fouling material which is more strongly attached to the bottom of the boat.

Conveniently, the handle of the implement is of adjustable length, for example is telescopic, to enable the length thereof to be varied to suit the particular boat being cleaned.

In an advantageous embodiment of the invention, the free end of the handle is provided with a boat hook, thereby producing a double purpose implement.

Desirably, the angle of the cleaning head relative to the handle is adjustable.

The handle of the implement may comprise a first portion to be held and manipulated by a user of the implement, the first and second handle portions being pivotally interconnected so that their inclination relative to one another can be set to achieve a desired angle of the cleaning head relative to the hand-held part of the handle to suit the particular circumstances.

In another form of the invention, the handle comprises a single portion pivotally connected directly to the hollow stock, for example by a pivot axle passing through aligned pivot apertures in interleaved ears provided on the stock and on the end of the handle.

In a preferred form of the invention, the cleaning head comprises a hollow stock which imparts buoyancy to the cleaning head and a cleaning structure which is attached to the hollow stock.

The buoyant hollow stock is preferably elongate transversely of the handle of the implement and may have a cylindrical shape.

The cleaning structure may include a cleaning device in the form of a strip of resilient material, such as synthetics plastics foam, attached to a mount for detachably securing to the stock so as to extend longitudinally thereof.

The mount of the cleaning device may be in the form of a channel-shaped member adapted to be clipped over a longitudinal mounting rail on the external surface of the stock and retained on the mounting rail in any suitable way, for example by making the channel member of resilient material and turning the edges of the channel inwardly for engagement in corresponding grooves in the mounting rail in the installed position of the mounting member.

If desired, the stock may be provided with a plurality of mounting rails at circumferentially spaced locations for receiving respective different cleaning devices to enable different cleaning actions to be applied to the boat bottom by the same head by changing the orientation of the implement. Preferably, the mounting rails are of identical form and the mounts of the cleaning devices are of identical form so that the cleaning devices are interchangeable, whereby any device may be used on any selected mounting rail. Various kinds of cleaning device may be provided: for example the mount of the device may carry a strip of synthetic plastics foam, a strip of rough-textured material such as nylon wool, a strip-like brush, or a plastics or rubber scraping blade.

Advantageously, means are provided for varying the buoyancy of the stock. For example, the stock may be provided with a filler cap to permit a desired quantity of water to be introduced into the stock to achieve a desired buoyancy. Conveniently, the stock is made of a transparent plastics material and is provided with graduations to indicate the volume of water introduced into the stock.

In a further embodiment of the invention, the detachable cleaning devices are adapted to be stored in the hollow stock when the implement is not in use, the stock being provided with a filler aperture at one end thereof which is dimensioned to allow the cleaning devices to be introduced therethrough into the stock.

BRIEF DESCRIPTION OF THE DRAWINGS

Further objects and advantages of the invention will become apparent from the following detailed description, given with reference to the appended drawings, in which.

DESCRIPTION OF PREFERRED EMBODIMENTS

Figure 1:
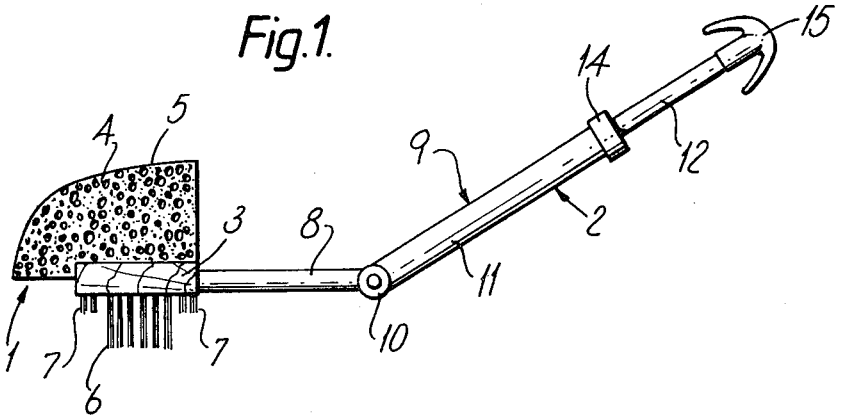
FIG. 1 is a side view of one embodiment of the cleaning implement according to the present invention.

Referring firstly to FIG. 1, a cleaning implement embodying the present invention comprises a cleaning head 1 carried at one end of a relatively long handle 2.

The cleaning head 1 comprises a stock 3 made, for example, of wood. The stock 3 is elongate transversely of the handle 2 and has attached thereto an upper body 4 of synthetic plastics foam. The foam body 4 imparts buoyancy to the head 1 and is also capable of serving as a cleaning structure as described hereinafter. The upper surface 5 of the foam body 4 is curved, as shown in FIG. 1, to provide a cleaning surface which is capable of satisfactory contact with the bottom of the boat when the cleaning head is submerged beneath the boat.

The underneath of the stock 3 is furnished with a central longitudinal strip of relatively long, soft bristle 6 disposed between two longitudinal strips of relatively short, hard bristles 7. The stock 3 is carried at the free end of a first relatively short handle portion 8 which is pivotally attached to a second longer handle portion 9 by a joint 10 having a locking element (not shown), such as a wing nut, which can be slackened to allow the angle between the handle portions 8 and 9 to be adjusted to a desired value and which can be tightened to hold the handle portions at the desired angle to one another.

The second handle portion 9 is telescopic in construction, the two sections 11 and 12 of the handle portion 9 being held together at a desired degree of extension by means of a suitable rotary locking element 14 which, when tightened, prevents relative axial movement of the two telescopic sections.

The free end of the second handle portion 9 may be provided with a suitable hand or finger grip (not shown) and/or may be provided with a boat hook 15 (as shown in FIG. 1) to form a double purpose implement, which serves both as a cleaning implement and as a boat hook.

In a modified form of the implement (not illustrated), a rubber wiper blade may also be affixed to the stock 3 in addition to, and on the same side as, the foam body 4 in order to provide a stronger wiping action on the hull surface, if required.

In use of the described implement to clean the bottom of a boat, the angle between the two pivotally connected handle portions 8 and 9 is adjusted to provide a suitable angle of the head relative to the surface of the boat, also bearing in mind the position from which the handle will be manipulated by the user. For example, the user may be standing on the shore or on another boat. The telescopic portion of the handle is also adjusted in length to suit the particular positioning of the user and the shape of the boat.

In order to clean the bottom of the boat, the cleaning head is pushed down into the water beneath the boat and the cleaning head is then allowed to float up into contact with the bottom of the boat. Cleaning can then be effected by merely pulling the cleaning head across the bottom by means of the handle or, if the fouling material is adhering more strongly to the bottom of the boat, the cleaning head may be reciprocated across the bottom of the boat by manipulation of the handle, so as to exert a scrubbing action on the boat bottom. In fact it is found that the fouling material is more readily removed from the boat bottom with the boat still in the water than with the boat out of the water, presumably because the material is still wet.

Enough buoyancy is obtained from the foam body and the stock of the cleaning head to ensure that the cleaning head makes good contact with the bottom of the boat which can be subjected to a wiping action, using the foam body, or a scrubbing action using the bristles in order to remove different kinds of fouling materials.

The bristles need not necessarily be separate bristles embedded in the stock of the cleaning head, but may be integrally moulded on the stock, if the stock is made of suitable material.

Figure 2:
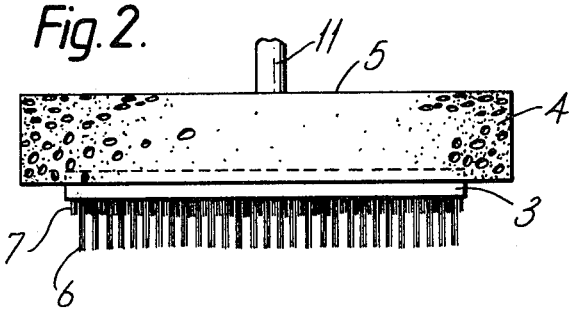
FIG. 2 is a front view of a cleaning head of the implement of FIG. 1.
Figure 3:
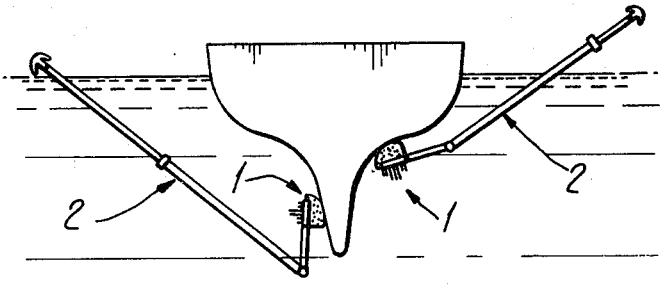
FIG. 3 illustrates the use of the implement of FIGS. 1 and 2 to clean the bottom of a boat.
Figure 4:
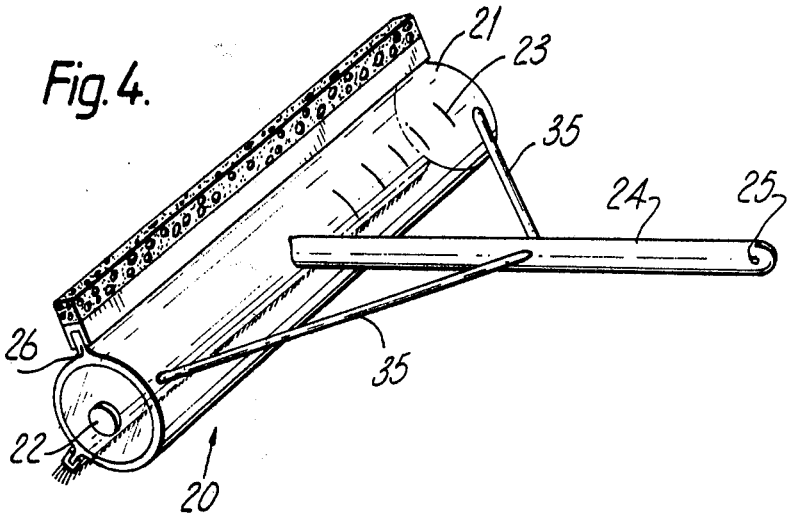
FIG. 4 is a schematic perspective view of the cleaning head of another embodiment of the cleaning implement according to the invention.
Figure 5:
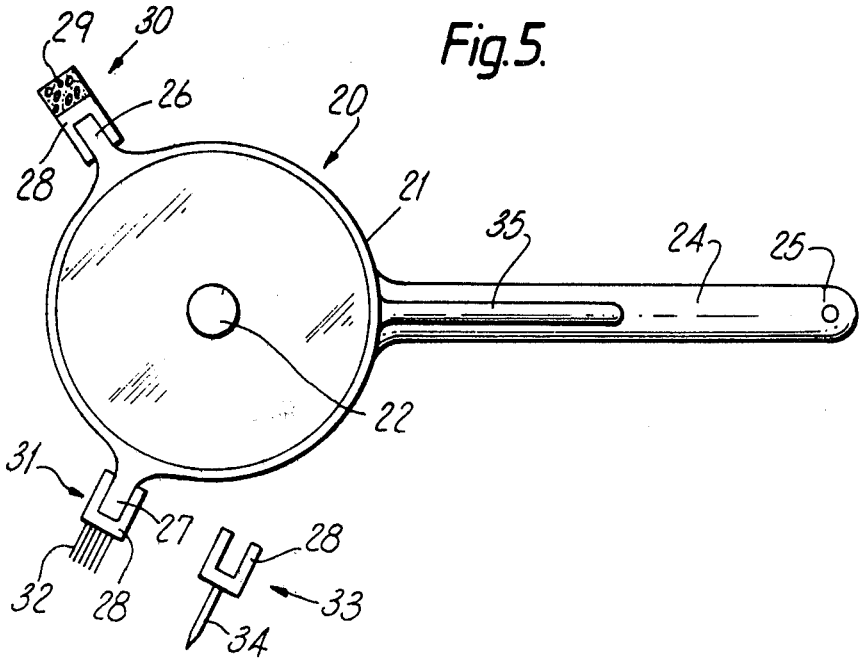
FIG. 5 is a schematic side view of the cleaning head of FIG. 1.

The cleaning head 20 shown in FIGS. 4 and 5 of the drawings comprises a hollow cylindrical stock 21 made of a transparent or translucent material, such as a synthetics plastics material. The stock 21 is closed at one end and is provided at the other end with a filler aperture, closable by a filler cap 22, to enable water to be introduced into the stock to vary the buoyancy thereof. Graduations 23 are provided along the cylindrical surface of the stock to indicate the quantity of water introduced into the stock and enable the resulting buoyancy to be judged. The stock is attached midway along its length to one end of a handle portion 24 whose other end is adapted to be pivotally attached to a second longer handle portion (not shown) by a joint 25. The second handle portion and the handle joint may be of the same construction as described for the first embodiment of FIGS. 1 to 3.

The cylindrical stock 21 is formed with two longitudinal radially extending mounting rails 26 and 27 for mounting detachable cleaning devices on the stock so that various combinations of cleaning action may be simultaneously provided on the stock. Various, interchangeable cleaning devices may be provided, each having a channel-shaped mount 28 for clipping onto a mounting rail 26 and 27, where it is retained, for instance, by inturned edges of the mount engaging in corresponding grooves in the mounting rail. FIG. 5 shows, by way of example, three kinds of cleaning device which may be attached to the stock 21, namely a wiping device 30 having a strip of synthetics plastics foam 29 fixed to mount 28, a brush device 31 having bristles 32 attached to mount 28 and a scraper device 33 having a plastics or rubber blade 34 attached to the mount 28. It is also envisaged that a pad of nylon wool or other rough-textured material could be attached to a mount 28 to form a cleaning device having a non-abrasive scouring action.

Anti-fouling shoulders are provided on the head 20, in the form of two struts 35 connected between the handle portion 24 and respective ends of the stock 21. Amongst other things, the struts 35 serve to prevent the head 20 from being trapped on the side of the keel remote from the user.

In use of the above described second embodiment of the implement to clean the bottom of a boat, the angle between the two pivotally connected handle portions is adjusted as described for the first embodiment and the buoyancy of the stock 21 is adjusted by introducing the required amount of water into the interior of the stock.

In order to clean the bottom of a boat, the cleaning head is pushed down into the water beneath the boat and the cleaning head is then allowed to float up into contact with the bottom of the boat. Cleaning can then be effected by merely pulling the cleaning head across the bottom by means of the handle or, if the fouling material adheres more strongly to the bottom of the boat, the cleaning head may be reciprocated across the bottom of the boat by manipulation of the handle, so as to exert a scrubbing action on the boat bottom. If necessary, the buoyancy of the stock of the cleaning head can be adjusted during use in order to optimise the cleaning action, by removing the cleaning implement from the water and introducing or removing ballast water from the stock.

The above described embodiment of the invention uses a foam cleaning device 30 which, because it is not required to impart buoyancy to the cleaning head, is of smaller volume, resulting in faster drying out after use and making it easier to lift the implement from the water.

The variable buoyancy of the stock of the cleaning head enables the buoyancy of the head to be altered to suit different circumstances and the volume graduations on the stock will enable the user very quickly to judge the required volume of ballast water in the light of experience.

Figure 6:
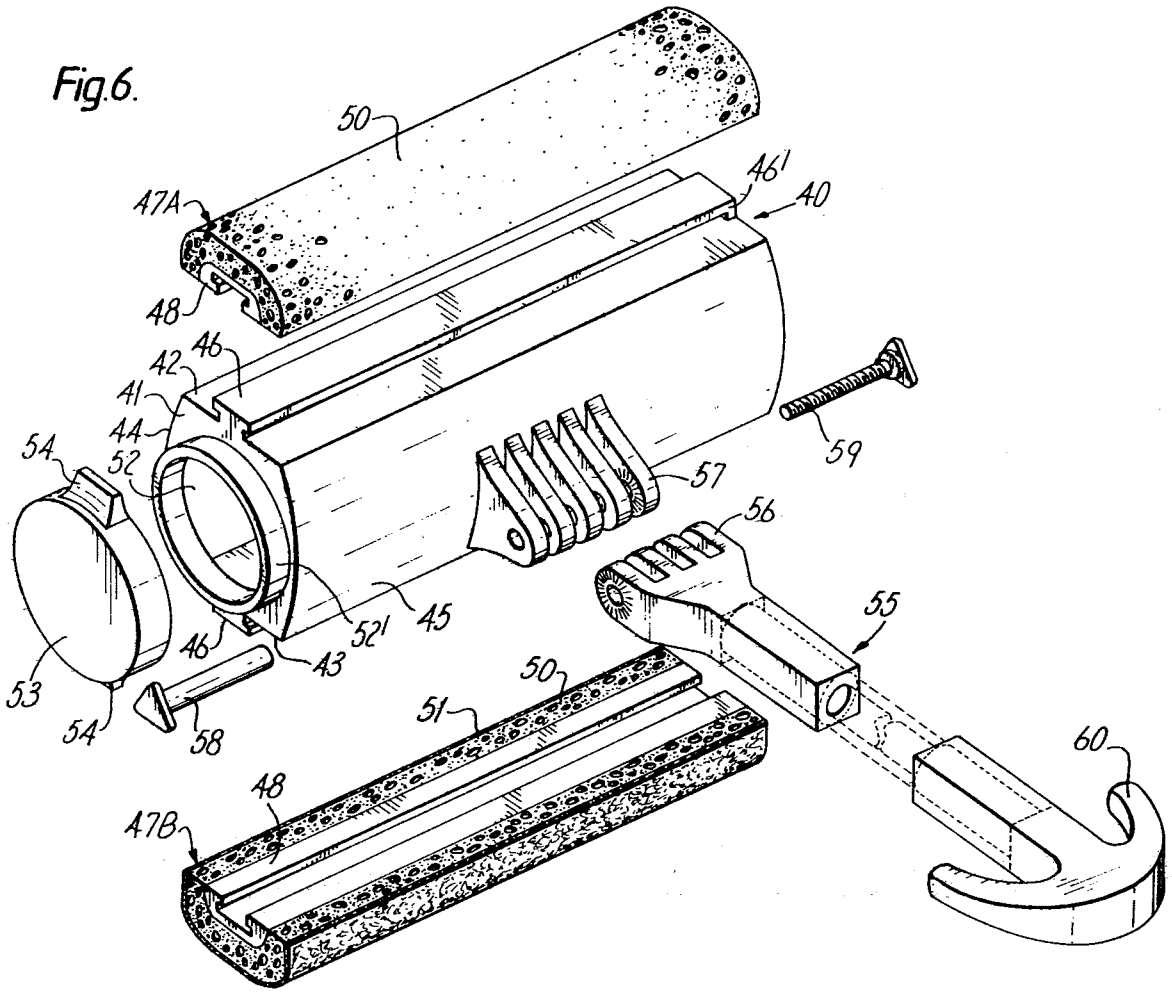
FIG. 6 is an exploded perspective view of a further embodiment of the cleaning implement according to the invention.

FIG. 6 illustrates a further embodiment of the invention, which has a hollow stock 41 enabling the buoyancy of the cleaning head 40 to be varied according to requirements.

The hollow, elongate stock 41 is moulded from a transparent or translucent synthetic plastics material and has a pair of parallel flat longitudinal walls 42, 43 interconnected by a pair of convex walls 44, 45. The flat walls 42, 43 present integrally moulded, longitudinally extending rails 46 for the attachment of respective cleaning devices 47 provided with plastics mounting channels 48 which are slid onto the rails 46 against end stops 46' at one end of the rails. Two examples of cleaning devices are shown in FIG. 6, namely device 47A which has a layer 50 of synthetic plastics foam and device 47B which has a layer of foam 50 and an outer layer 51 of a material having a rough-texture. The devices 47A and 47B are interchangeable and clearly further cleaning devices employing other cleaning materials, such as bristles, can be provided as required.

The stock 41 has a filler aperture 52 at one end thereof to enable water to be introduced into the stock to vary its buoyancy and graduations (not shown) may be provided along the stock to indicate the quantity of water in the stock as in the embodiment of FIGS. 4 and 5.

The filler aperture 52 is closable by a threaded filler cap 53 co-operating with a threaded collar 52' formed around the aperture 52. The aperture 52 is dimensioned to allow the cleaning devices to be inserted into the hollow stock 41 for safe and tidy storage when the implement is not in use. The filler cap 53 presents projecting abutments 54 for retaining the mounted cleaning devices 47 on the rails between such abutments and the end stops 46'.

The handle 55 of the implement may be moulded from synthetic plastics material and is of extendable construction as in the previous embodiments, the arm being formed with a boat hook 60 at its free end. The other end of the handle 55 is directly pivoted to the stock 41 by means of four apertured pivot ears 56 which are interleaved with five apertured pivot ears 57 moulded on the convex wall 45 of the stock. The interleaved ears 56, 57 are held together by a two-part pivot shaft adapted to extend through the aligned apertures in the ears and comprising a hollow bolt 58 internally threaded to co-operate with an externally threaded bolt 59. The bolts 58 and 59 may be moulded from synthetic plastics material.

I claim:

1. A hand-manipulable cleaning implement, for cleaning the bottom of a boat while the boat remains in the water, which comprises an elongated handle; a cleaning head, including a single elongate hollow stock, which is attached to, and elongate transversely of said handle, said hollow stock being provided with a filler aperture, a removable filler cap for closing said aperture, and a plurality of external, circumferentially spaced, longitudinal mounting rails for receiving respective different cleaning devices comprising strips of resilient material attached to channel-shaped mounts for detachably secured engagement with the respective mounting rails, whereby said strips extend longitudinally of said hollow stock; wherein said mounting rails of said cleaning head are of identical form and the mounts of said cleaning devices are of identical form so that said cleaning devices are interchangeable and any cleaning device may be attached on any selected mounting rail; and said filler aperture being large enough to permit throughpassage of and such hollow stock being large enough to permit storage therein of said cleaning devices; said filler cap being removable for permitting the introduction, through the said filler aperture into said stock, of either said detachable cleaning devices and of a desired quantity of water to adjust the buoyancy of the stock of the cleaning head during use to optimize the cleaning action of the implement in cleaning a boat bottom by movement of said cleaning head over the boat bottom as a result of manipulation of said handle.

2. An implement as claimed in claim 1, wherein the handle is of adjustable length to enable the length thereof to be varied to suit the particular boat being cleaned.

3. An implement as claimed in claim 1, wherein the angle of the cleaning head relative to the handle is adjustable.

4. An implement as claimed in claim 3, wherein one end of said elongate handle is pivotally attached directly to said hollow stock, whereby the angle of said cleaning head relative to said handle is adjustable.

* * * * *